United States Patent [19]

Maier

[11] 4,235,411

[45] Nov. 25, 1980

[54] DEVICE FOR CONNECTING STRUCTURAL FORM PANELS

[76] Inventor: Josef Maier, Kreuzbühlstr. 5 D-7611 Steinach, Fed. Republic of Germany

[21] Appl. No.: 98,138

[22] Filed: Nov. 28, 1979

[30] Foreign Application Priority Data

Nov. 29, 1978 [DE] Fed. Rep. of Germany ..... 2851549

[51] Int. Cl.[2] ..... E04G 9/00; B28B 7/12

[52] U.S. Cl. ..... 249/193; 249/189; 249/192

[58] Field of Search ..... 249/188, 187, 189, 192, 249/193, 207, 205, 210

[56] References Cited

U.S. PATENT DOCUMENTS

| | | | |
|---|---|---|---|
| 1,212,499 | 1/1917 | Kemon | 249/193 |
| 1,292,986 | 2/1919 | Ambursen | 249/193 X |
| 1,308,269 | 7/1919 | Wales | 249/193X |
| 1,311,282 | 7/1919 | McKay | 249/193 |
| 1,312,462 | 8/1919 | Wales | 249/193 X |
| 1,315,027 | 9/1919 | McKay | 249/193 |
| 2,763,911 | 9/1956 | Rumble | 249/189 X |
| 3,117,358 | 1/1964 | Kitchen | 249/188 |
| 3,547,396 | 12/1970 | Oueilhe | 249/189 X |
| 3,666,229 | 5/1972 | Carrel-Billiard | 249/189 X |
| 3,762,678 | 10/1973 | Thornton | 249/193 |

*Primary Examiner*—J. Howard Flint, Jr.
*Attorney, Agent, or Firm*—Michael J. Striker

[57] ABSTRACT

A device is provided for connecting structural panels used to make pouring forms for concrete. It includes a connecting element dimensioned to fit between juxtaposed edge faces of adjacent form panels and having two sides one or both of which are provided adjacent the proximal edge faces of the panels with a longitudinal slot in which fasteners are engageable.

10 Claims, 4 Drawing Figures

DEVICE FOR CONNECTING STRUCTURAL FORM PANELS

BACKGROUND OF THE INVENTION

This invention is concerned with a device for connecting structural form panels, especially in the region of offsets of a structure, the form panels being of the type having at least at their margins webs or the like which are preferably provided with engagement portions for fastening means.

A device of this type, for the connection of form panels in the region of building offsets, is already known from German allowed application No. 1,902,568. The end faces of the form panels are formed by stiffening frames. Rails having mold parts corresponding to one another and fitting in one another, and which can also form a tension-resistant tongue-and-groove connection are secured to these endfaces. This connection permits the desired vertical displacement relative to one another of the nested mold parts, and consequently also of the form panels connected thereto. However, for this tension-resistant tongue-and-groove connection correspondingly expensive connecting parts are required which moveover, take up a relatively large part of the form face width. Furthermore, there is the risk that the mold parts which are plugged into one another may subsequently be detachable from one another only with difficulty, especially in the region of the plug connection, due to contamination which can frequently occur during concreting.

SUMMARY OF THE INVENTION

The object of the invention is therefore to provide a device of the above-mentioned type with which form panels offset in relation to one another can be fastened to one another, wherein the number of parts required is kept small and in which the release of the connection is not put at risk even in the event of contamination with concrete. While meeting these requirements, the storage requirements of the device are to remain as small as possible.

To solve this problem, the device according to the invention has a connecting element which fits between the webs or similar elements of the form panels and is there fixable. This element has on at least one of its two sides, adjacent the end faces of the form panels to be connected, at least one longitudinal slot extending in its longitudinal direction and for serving the engagement of the fastening means. A form element is attachable or arranged on at least one face of the connecting element which is situated at right angles to the slotted sides.

In this way a device is obtained with which even form panels which are offset in relation to one another, can be connected with a single connecting element and using the same fastening means otherwise used to connect form panels located adjacent to one another. Due to the use of the longitudinal slot a possibility for stepless adjustment is obtained. The connecting element can be relatively narrow and is easily introduced into a form, since it has itself a form skin.

The width of the longitudinal slot corresponds approximately to the dimension of the fastening means for the connection of the webs or other elements and both side walls preferably each have a longitudinal slot to enable an offset of two form panels to be "distributed" to both sides of the connecting element. The spacing of the longitudinal slots from the margin of the connecting element adjacent the concrete can correspond to the spacing of the fastening locations on the webs or the like of the form panels from the form. This ensures that the form of the connecting element is aligned in functional position with the form of the adjoining form panels which are preferably arranged in a common plane.

The width of the connecting element from the surface of the one slotted side wall to the other can corresponds approximately to a grid values of the wall thickness and preferably amount to about 5 or 6 cm. Due to the selection of such a value the fastening bolts extending from both sides have sufficient room on the inside of the connecting element even when they are located at the same height. Furthermore, a good adaptation to different standard values in the building trade is obtained.

It is especially advantageous if the extension of the connecting element at right angles to the form, especially that of its slotted side walls, corresponds to the width of the webs or the like at the margin of the form panels. Due to this and due to the use of connecting bolts which have stop means in form of projections extending transversely to their elongation, a connection of the offset form panels can be effected without projecting parts extending from the rearside of the form wall, which can obstruct the arrangement of flanges, beams or the like.

An especially advantageous feature is the fact that a single connecting element is sufficient and that it is not necessary to provide parts fitting into one another in a form-locking manner at the adjacent margins of the form panels which are to be offset in relation to one another. The fastening means already provided for the connection of the form panels, namely especially bolts with crosspins or optionally also with nuts or knock-in wedges, can allow a mutual vertical displacement in conjunction with the connecting element which is slotted on both sides.

According to one embodiment of the invention it is possible also for that side of the connecting element which faces rearward in the functional position, to have an especially smoothly continuous closure optionally as second form skin. The element can then be used in any desired orientation; hence it can also be turned through 180° about its longitudinal axis, which can simplify the installation and increase the life of the element. Especially with such a substantially closed connecting element it is advantageous to use fastening means in form of bolts which have at their free end projecting crosspins or similar stops which can fit through keyhole-like perforations and be locked by turning.

The above-mentioned optional installation of the element is favoured if the longitudinal slots are situated in the middle of the side walls of the connecting element. This is of advantage when a single such longitudinal slot is provided. Several parallel longitudinal slots could optionally be provided, if parallel rows of perforations for the mutual fastening are provided on the form panels.

The device according to the invention allows effective cleaning by access through the longitudinal slots even with a closed form of construction. Of only one side is closed by a form skin, the cleaning possibility is even better. A further substantial advantage, especially of the connecting element, consists in that it can also be fastened in the same way on horizontal margins of corresponding form panels, and e.g., transverse form panels which then no longer correspond in their width extension to the subjacent form panels can then also be connected. If the connecting element has clamping points, the form panels arranged on both sides thereof can be braced thereby.

Furthermore, a substantial advantage of the connecting element is that it can overlap form-panel butt joints extending transversely to its elongation so that it offers an additional reinforcing effect for the entire form. This can be utilized both with a vertical and with a horizontal arrangement of the connecting element for joints extending respectively horizontally or vertically. The element thus performs the function of an additional beam or of a flange without projecting beyond the outline of the form panels. For this reinforcing effect the connecting elements are, along the elongation of the form, either offset as a whole in relation to the form panels or are provided in correspondingly modified lengths, so that they can intersect and overlap the form-panel butt joints extending transversely to their elongation. Form corners can also be connected to form panels and may be optionally offset relative to the same.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 2:
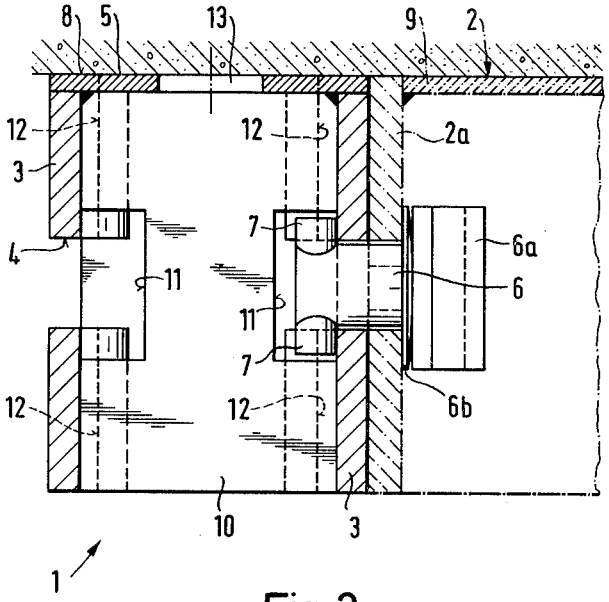
FIG. 2 is a cross-section on an enlarged scale through a connecting element according to FIG. 1, a connected form panel being shown on a reduced scale.
Figure 3:
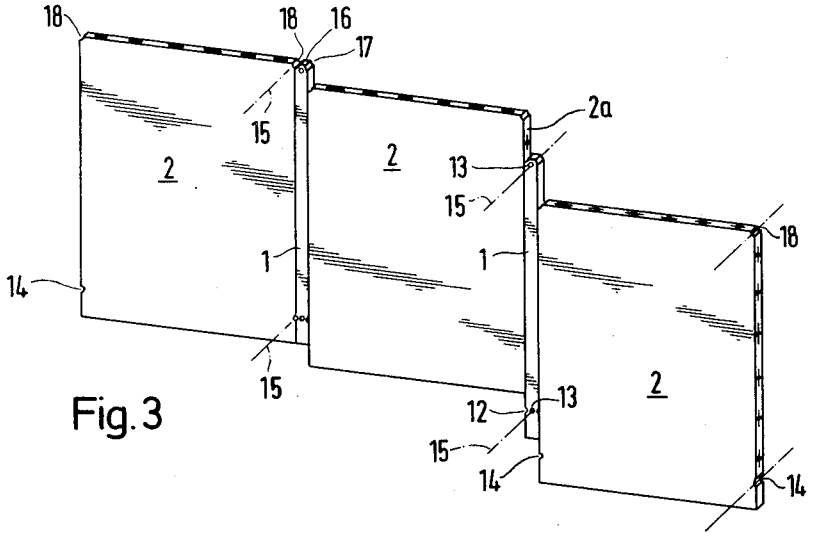
FIG. 3 is a schematic illustration showing the connection of three form panels which are offset vertically in relation to one another.
Figure 4:
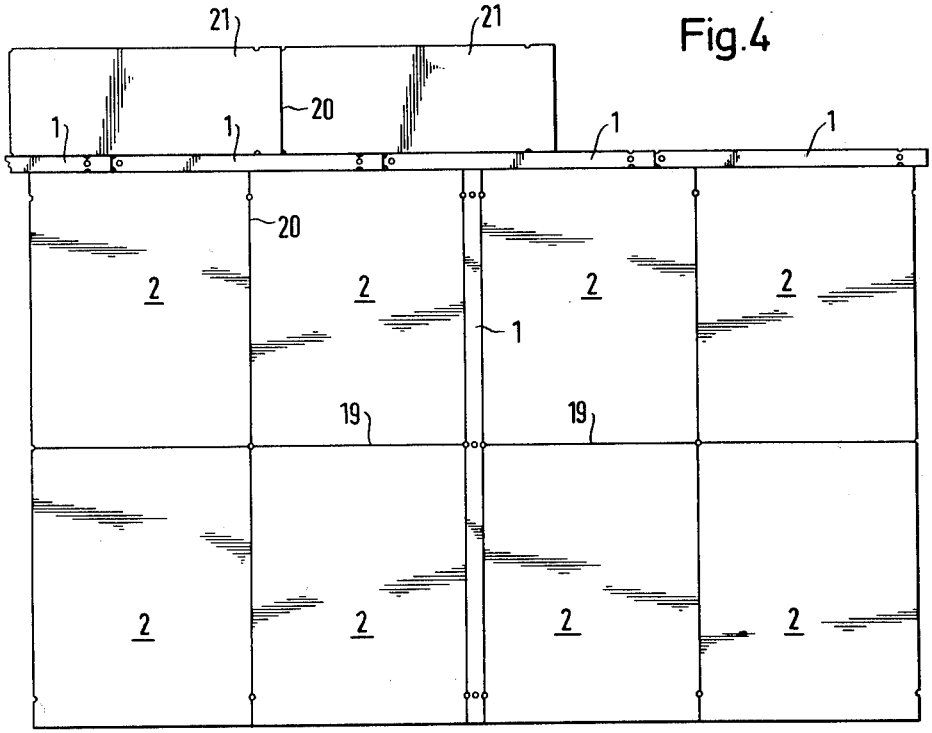
FIG. 4 shows a form of application of the invention where a connecting element projects above the height of two form panels and bridges the transverse joint therebetween, and where additional connecting elements for the connection of narrow or transverse form panels are provided for an upper continuation of the form wall.

A device for the connection of form panels which can be offset in relation to one another in one or another form, as illustrated in FIG. 3 by way of a vertical offset and in FIG. 4 by way of an offset in respect of the dimensions of the form panels, has a connecting element 1 (FIG. 1) which fits between the webs 2*a* forming the end faces of the form panels 2. This connecting element 1 is provided on its two side walls 3 adjacent the end faces of the form panels 2 to be connected, with longitudinal slots 4 extending in its longitudinal direction and serving for the engagement of fastening means; it also has a form skin 5 on a face situated at right angles to the slotted side walls 3. In the examplary embodiment the fastening means are bolts 6 with stop projections 7 which are arranged transversely to the bolt elongation and which can be pushed through keyhole-like perforations in the webs 2*a* and then be locked by turning of the bolts. In the inserted position they also fit through the longitudinal slots 4, while in the turned position they grip above the margins of the longitudinal slots 4 from behind with their stop projections 7 (FIG. 2). The width of the longitudinal slots 4 is selected to correspond to the diameter of the bolts 6.

The spacing of the longitudinal slots 4 from the margin 8 of the connecting element 1 adjacent the concrete corresponds to the spacing of the fastening location or of the perforation for the bolt 6 on the webs 2*a* for the form panel 2, from the form skin 9 thereof. FIG. 2 shows that in the function position the form skin 5 of connecting element 1 is aligned with the form skin 9 of the adjoining form panels 2 which in one plane in the exemplary embodiments according to FIGS. 3 and 4, are located in a common plane. Form corners, form-removing devices or the like can optionally also be connected.

The width of the connecting element 1 from the surface of the one slotted side wall 3 to the other corresponds appropriately to a grid value of wall thickness and amounts preferably to about 5 or 6 cm.

The extension of the connecting element 1 at right angles to the form skin 5, especially that of its slotted side walls 3, corresponds in the exemplary embodiment to the width of the webs 2*a* at the margin of the form panels 2. When these connecting elements 1 are used this results in a smooth form wall not only on the side adjacent the concrete, but also on the rearside remote therefrom. Also, the fastening means, i.e., here the bolts 6, do not project beyond the outline of the form at the rear, since they disappear in the reinforcement thereof.

In the exemplary embodiment the longitudinal slots 4 are each situated in the middle of the side walls 3 of the connecting element 1. This is appropriate for form panels where the perforations for the fastening means 6 are likewise arranged in the middle of the webs 2*a*. If these perforations are arranged eccentrically, however, then the longitudinal slots 4 must also be arranged correspondingly.

The exemplary embodiment provides in an especially simple and effective way for a longitudinal slot 4 to be continuous from bottom to top of the element 1, especially on each of the two sides of the connecting element 1. There could optionally also be provided several longitudinal slots which are aligned with one another, but are interrupted by intermediate webs in order to increase the stability of the connecting element 1. However, a fastening element 6 could not then be used at the points where these longitudinal slots would be interrupted. The use of a continuous longitudinal slot 4 according to the exemplary embodiment is therefore especially advantageous for a stepless adjustment and to permit arbitrary offsetting of form panels to be connected to one another.

In the exemplary embodiment the inside of the substantially hollow connecting element 1 is provided with reinforcing plates 10 which are arranged transversely to its longitudinal extension and which, if the connecting element 1 is made from metal or sheet-metal strips, can be stiffening elements for it. In such a case the element 1 may be manufactured by welding in the region of the longitudinal slots 4 these reinforcing plates 10 each having a cutaway 11 whose contour corresponds at least to the projection of that part of the connecting bolt 6 or of another fastening means which extends into the connecting element 1. This arrangement can be seen in FIG. 2 where the cutaway 11 is rather larger than the part projecting therein of the bolt 6 with its stop projection 7. Such bolts 6 thereby fit also directly into the longitudinal slots 4 in the region of the reinforcing plates 10.

It is especially advantageous if the connecting element 1 has clamping points so that the form panels 2 connected to it can be braced, together with this connecting element 1 or via this connecting element 1. In this connection it is especially advantageous if the connecting element 1 has on at least one side face 3 at least one marginal cutaway 12 extending thereover and in addition thereto or in lieu thereof, at least one perforation 13 (see especially FIG. 2) in its form skin 5 and serving as clamping point; the rear side of the connecting element 1 remote from the concrete is then preferably open. If this rear side is closed, it likewise has opposite the perforation 13 a passage for a clamping element. The open rear side also allows a somewhat oblique arrangement of a form tie rod which extends through the perforation 13.

The embodiment of FIG. 3 shows that several clamping points can be arranged next to one another in the lower region of the connecting element 1, such clamping points being formed by at least one perforation 13 in the form skin 5 and at least one marginal cutaway 12 located especially at the same height on one side face. In the exemplary embodiment even two such marginal cutaway 12 may be provided, located at the same height. These cutaways 12 are arranged in the one end region and have an approximately semi-circular cross-section which together with a corresponding marginal cutaway 14 of an adjoining form panel 1 located in a correspondingly matching position, forms a round clamping point for a form tie rod as suggested in the left part of FIG. 3 where a form tie rod 15 is shown in dot-and-dash line. In the right part of FIG. 3 the marginal cutaways 14 of the form panels do not fit together with the marginal cutaways 12 of the connecting element, so that the perforation 13 can be utilized there to introduce a form tie rod 15.

Figure 1:
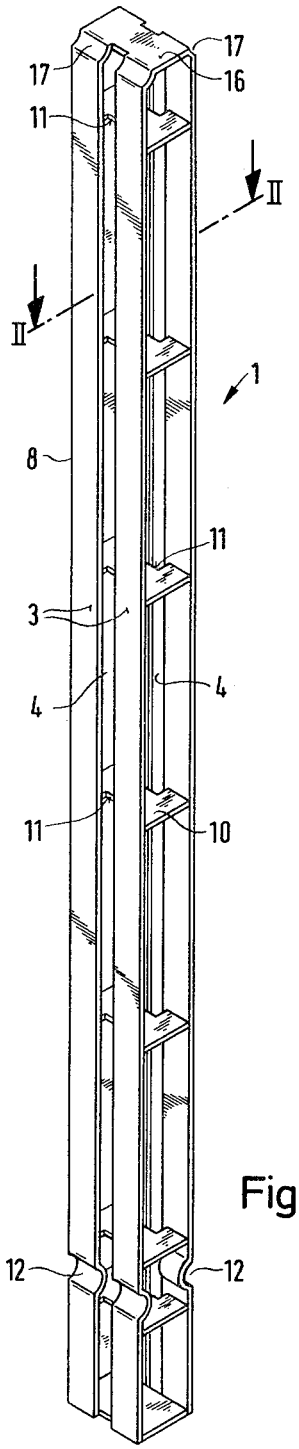
FIG. 1 is a diagrammatic representation of the side wall and rear side of a connecting element for the connection of form panels which can be offset in relation to one another.

FIGS. 1 and 3 also show that a preferably quadrant-shaped marginal cutaway 17 is provided at one end of the connecting element 1, in this case at the upper end, in the transitional region of the side faces 3 to the end face 16 on at least one side, but in the exemplary embodiment again on both sides. The radius of curvature of cutaway 17 corresponds, as with the semi-circular marginal cutaways, approximately to the radius of a form tie rod 15. The left part of FIG. 3 shows that a connection to a correspondingly shaped form panel 2 which has in its corner region likewise a quadrant-shaped marginal cutaway 18, establishes a semi-circular cutaway which can be completed with corresponding further cutaways to form a clamping point. In this end region near the quadrant-shaped marginal cutaways 17, a perforation 13 is provided which acts as clamping point and passes through the form skin 5 of a connecting element 1. This perforation can be used when a vertical offset of the connecting element 1 is effected, as illustrated in the right part of FIG. 3, whereby the quadrant-shaped marginal cutaways 17 are therefore not completed to form a clamping point, but the arrangement of a form tie rod 15 is appropriate in this end region of the connecting element 1. Primarily when a larger vertical offset is desired, it is advisable if the connecting element 1 extends over an equally large portion of the length of the form panels adjacent one another, but offset vertically in relation to one another.

The clamping points on the connecting element 1 have the considerable advantage that the clamping forces can be transmitted from them to the directly connected form panels, so that it may be possible to save clamping points.

FIG. 1 also shows that in the region of the clamping areas provided on the connecting element 1, the reinforcing metal sheets 10 arranged around them also serve as bearings for the tightening nuts on the rear side of the connecting element 1, i.e., the side remote from the concrete. It is shown clearly that in the regions where such clamping areas 12 or 17 and 13 are provided, the reinforcing plates 10 are arranged closer to one another or, in the upper region, closer to the upper closure plate 16. This increases the stability of these clamping areas and provides a good bearing for the nuts which are screwed onto the form tie rods.

In the exemplary embodiment the connecting element 1 is welded together from sheet-metal strips and the side walls 3 may each be optionally formed from two strips which are parallel in the longitudinal direction and are aligned with one another with their surfaces and leave the longitudinal slot 4 free between them. Further advantageous applications of the invention are illustrated in FIG. 4. This Figure shows a vertical connecting element 1 which extends over a larger height than the individual form panels 2. It therefore overlaps or bridges the horizontal joint 19 between the form panels 2 standing on one another. This region is thereby better reinforced, so that the connecting element 1 can also fulfil the function of an additional beam due to its additional reinforcing effect.

Furthermore, FIG. 4 shows how such connecting elements 1 can, due to a horizontal arrangement, bridge and reinforce the vertical points 20 between form panels 2 standing next to one another. It is also illustrated that this permits securing, at a level above form panels of equal size further form panels 21 which differ in their dimensions. It is seen in FIG. 4 how two transverse rectangular form panels are attached, which are larger in their horizontal longitudinal extension than the width of the form panels situated thereunder. Here, also, an offset of the form panels and their margins in relation to one another is obtained, but this offset is bridged by the connecting element 1. The connecting elements 1 can have different lengths, to be adapted to different form panel dimensions. However, since they can abut one another directly, the desired purpose can be achieved with a single length. An additional advantage of such a horizontal arrangement of the connecting elements 1 continuing one another consists in that a good reinforcement is also obtained in the region of joints 20 abutting these parts perpendicularly, so that this arrangement can fulfil at least partly the additional purpose of a flange. It is advantageous, both in the case of a horizontal and also in the case of a vertical arrangement of these connecting elements 1, that these parts do not project beyond the outline of the form and can be connected with the same fastening elements with which the form panels 2 can otherwise be fastened to one another, so that these fastening elements, do not project from the rear side of the form panels. They therefore represent no obstruction for any additionally necessary beams, flanges, brackets and similar parts to be connected to the rear side of form wall.

All in all, owning to the connecting element according to the invention, there can be achieved a vertical offset or another offset of form panels or a bridging of form joints for the purpose of a reinforcement with a single part which can even be connected with those fastening means that otherwise serve to connect the form panels themselves to one another.

Still another advantage resides in the fact that by means of the bolts 6 and the stop projections 7, as well as a correspondingly sized intermediate space between the top projections 7 and the head 6*a* of the bolt, or by means of an interposed cup spring 6*b*, such a large clamping force can be generated that the parts can be connected to one another sufficiently firmly to remain in the set position. Additional measures to fix the selected vertical offset can therefore be omitted.

The open form of construction shown in FIG. 1 of the connecting element 1 facilitates cleaning thereof and, when the perforations 13 are used for form tie rods, also allows an inclined orientation thereof in relation to a perpendicular line to the form skin 5, due to which an improved adaptability of the entire form and a compensation of tolerances at clamping areas e.g., not situation exactly opposite one another, are possible.

Altogether, there is obtained a simple to handle device with which it is possible to connect form panels which are vertically offset in relation to one another or which do not match one another in respect of their length dimensions or the arrangement of their fastening points. Moreover, a stepless adjustment of arbitrary displacements is possible and form panels matching one another in their dimensions can be reinforced additionally in a form wall by means of this device. Besides the use of the above-described bolts, which are also suitable for connecting the form panels to one another, other fastening means can be provided, such as bolts with nuts, with wedges or the like, although it is always preferable to use those connecting means which are also otherwise provided in relation to the form. Finally, it should also be mentioned that instead of form tie rods provided with nuts it is also possible to provide the same with wedges, the reinforcing plates 10 in the region of the clamping points being advantageous under these circumstances too, since they can form a bearing for a wedge, also.

In a modified form of construction, or as a supplement to the above-described form of construction, the rear side of the connecting element 1 remote from the form skin 5 can have a closure which has fastening areas for the fastening means, especially keyhole-like perforations, or at least a longitudinal slot with a width corresponding to the diameter of connecting bolts 6 or the like. The connecting element can thereby be used also as a corner piece or for a rectangular termination of a form skin. When a longitudinal slot is employed, a vertical offset is then possible as well. This can be appropriate primarily with a horizontal arrangement of the element at the upper margin of a form, when a cantilever is to be sheathed there. Even one of the side walls could optionally be completely closed or closable in order to be able to form an inner corner.

Contrary to the above-described exemplary embodiment one of the side walls 3, preferably one situated opposite the longitudinal slot 4 of the other side wall 3, can have at least one row of astening perforations for the fastening means, such as connecting bolts 6. A longitudinal slot is then always available for a vertical offset, and a jump in the vertical offset of the element from perforation to perforation is also possible. If the hole spacings are selected correspondingly, these jumps will be relatively small, so that a sufficiently good bridging of a vertical offset is possible due to the stepless adjustability at the longitudinal slot.

While the invention has been illustrated and described as embodied in an arrangement for connecting form panels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a device for the connection of concrete-form panels, particularly in the region of building offsets wherein the form panels are at least at their margin provided with webs or the like which form their lateral faces and which may have engagement areas for fastening means, such as recesses for bolts with stop projections or the like that extend transversely of the bolt elongation, the improvement comprising a connecting element dimensioned to fit between the webs of the adjacent form panels to be fixed thereat and having two sides at least one of which is provided adjacent the lateral faces of the form panels to be connected with at least one longitudinal slot extending in longitudinal direction for the engagement of the fastening means; and a form skin attachable to at least one face of the connecting element which is situated at right angles to the slotted sides.

2. Device as defined in claim 1, wherein the width of said longitudinal slot corresponds to the dimension of the fastening means and both sides walls each have one such longitudinal slot.

3. Device as defined in claim 1, wherein the spacing of the longitudinal slots from a margin of the connecting element which is remote from the concrete being confined in the form corresponds to the spacing of the fastening areas on the webs from the surface of the form skin of the panels.

4. Device as defined in claim 3, said connecting element having a form skin aligned in the functional position with the form skin of the adjoining form panels.

5. Device as defined in claim 2, wherein the width of the connecting element from a surface of one slotted side wall to the surface of the other slotted side wall corresponds approximately to a grid value of the wall thickness.

6. Device as defined in claim 2, wherein the elongation of the connecting element at right angles to the form skin, corresponds to the width of the webs at the margin of the form panels.

7. Device as defined in claim 1, wherein the side of the connecting element which faces rearward in the functional position of the element has a smoothly continuous closure.

8. Device as defined in claim 2, wherein the longitudinal slots are each situated in the middle of the respective side walls of the connecting element.

9. Device as defined in claim 1, wherein a longitudinal slot continuous from bottom to top is provided on each of two sides of the connecting element.

10. Device as defined in claim 1, wherein the connecting element is substantially hollow and provided at its inside with reinforcing plates.

* * * * *